United States Patent [19]

Funk et al.

[11] 4,297,950

[45] Nov. 3, 1981

[54] TOW TRUCK

[75] Inventors: Larry J. Funk; Eugene A. Bluhm, both of Faribault, Minn.

[73] Assignee: Nutting Truck and Caster Company, Faribault, Minn.

[21] Appl. No.: 134,128

[22] Filed: Mar. 26, 1980

[51] Int. Cl.[3] ..... B65G 17/42; B61B 13/00

[52] U.S. Cl. ..... 104/172 BT

[58] Field of Search ..... 104/172 BT, 172 R, 172 B, 104/170, 178; 180/91-93; 74/106, 110, 520

[56] References Cited

U.S. PATENT DOCUMENTS

| | | | |
|---|---|---|---|
| 3,295,462 | 1/1967 | Bradt | 104/172 BT |
| 3,495,547 | 2/1970 | Bishop | 104/172 BT |
| 3,581,670 | 6/1971 | Larivee | 104/172 BT |
| 3,789,767 | 2/1974 | Krammer | 104/172 BT |
| 3,810,428 | 5/1974 | Klamp | 104/172 BT |

*Primary Examiner*—Richard A. Bertsch

*Attorney, Agent, or Firm*—Dorsey, Windhorst, Hannaford, Whitney & Halladay

[57] ABSTRACT

A tow truck of the type having wheels supporting it for movement along a path defined by a subfloor conveyor. There is a vertically movable tow pin at the front of the truck for vertical movement in and out of driving engagement with the conveyor. An accumulation bumper at the front of the truck is movable between a forward normal running position and a rearwardly retracted accumulating position when the bumper engages an object ahead of the truck. A connecting mechanism between the bumper and tow pin includes at least one bell crank member pivoted for rotation on a transverse axis behind the tow pin with a first lever arm projecting upwardly and connected by a link to the bumper, together with a second lever arm projecting forwardly and connected to a vertical lift rod, the upper end of which is operatively connected to the upper portion of the tow pin.

12 Claims, 6 Drawing Figures

Fig. 1
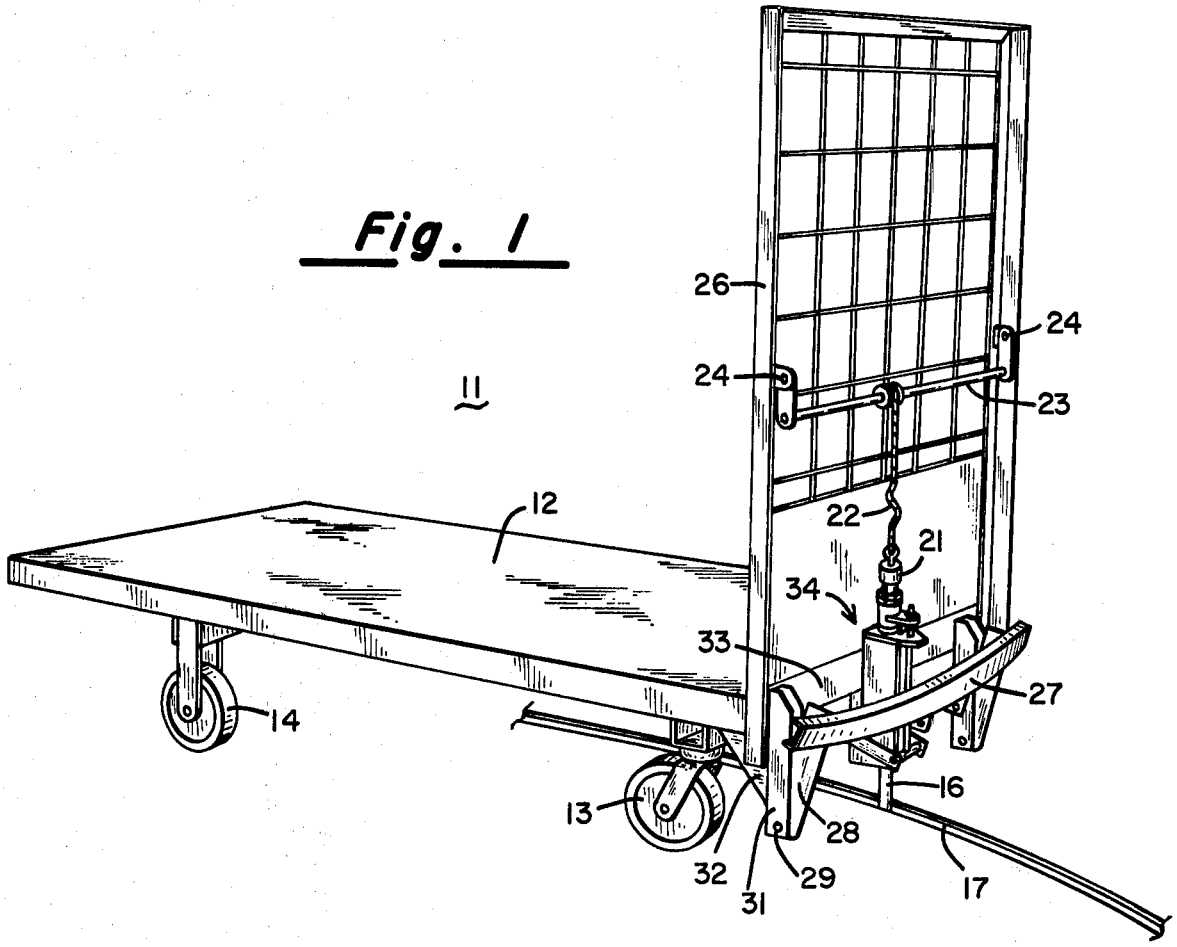
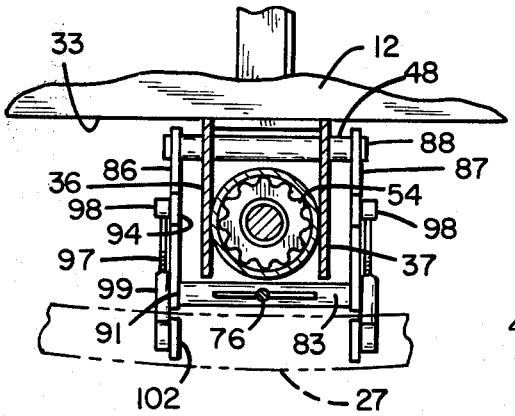
Fig. 5
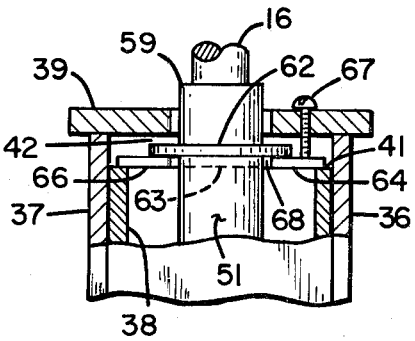
Fig. 6

TOW TRUCK

BACKGROUND OF THE INVENTION

The invention relates to tow trucks of the type in which the truck is movable along a selected path by engagement of a suitable tow pin mounted on the truck with a driving conveyor mounted in a channel in the supporting floor below the truck.

Such trucks have been provided with vertically movable tow pins which have been mounted at various positions along the truck body, usually at the front end. Such trucks have also been provided with front bumpers of various design and with interconnecting mechanisms by which the tow pin can be lifted out of engagement with its driving conveyor in response to engagement of a front bumper with an obstacle encountered by the truck during its forward movement. In some cases the obstacle may be another truck, and such bumpers are therefore sometimes referred to as accumulation bumpers, since they are designed to stop and accumulate all of the trucks moving along the conveyor, if the leading truck encounters an obstacle.

Some of the prior constructions for this purpose are shown in such patents as Burrows U.S. Pat. No. 3,027,850 and Goodrich U.S. Pat. No. 3,148,634.

In some installations such as warehouses, where large numbers of tow trucks are used, it is desirable to keep the total length of the truck to a minimum. Thus, there is a continuing need for improved arrangements of tow pin assemblies and accumulation bumpers, in which these members are arranged and provided with mechanical interconnections which permit the tow pin to be located at the front of the truck, but with minimal forward extension of the total truck length.

SUMMARY OF THE INVENTION

The present invention provides an improved tow truck of the type having wheels supporting the truck for movement along a path defined by a floor conveyor, a generally vertical tow pin at the front of the truck movable between a lower driving position for driving engagement by such conveyor and an upper retracted position out of driving engagement with such conveyor, and an accumulation bumper at the front of the truck movable between a forwardly projecting normal running position ahead of the tow pin and truck and a rearwardly retracted accumulating position in response to engagement of the bumper with an object ahead of the truck, in which an improved connecting mechanism between the bumper and tow pin comprises at least one bell crank member pivoted for rotation on a transverse axis behind the tow pin and having a first lever arm projecting upwardly from such pivot and a second lever arm projecting forwardly from such pivot along a side of the tow pin, a longitudinally-extending connecting link having a rear end pivotally connected to the upper end of the first lever arm and a forward end pivotally connected to the bumper and rocking the first lever arm rearwardly in response to movement of the bumper to retracted position, and a vertically extended lifting rod having a lower end pivotally connected to the forward end of the second lever arm and an upper end connected to the tow pin and lifting the tow pin in response to rearward rocking of the first lever arm by the bumper and connecting link.

In a preferred embodiment of the invention, two such bell crank members are provided, one at each side of the tow pin. In this case, the vertically extending lifting rod has a cross bearing tube in its lower end, which may be pivotally supported on a cross shaft extending between the outer ends of the second lever arms of the two bell crank members.

A further feature of the invention involves the provision of a compact tow pin assembly and housing, in which the two pin housing itself is provided with a suitable bearing, such as a transversely extending bearing tube positioned behind the tow pin. Such a housing can then be readily connected with the front of the tow truck, to provide a compact assembly of both the tow pin mechanism and the connecting linkage between the tow pin and the accumulating bumper at the front of the truck.

Other features and details of the invention will be apparent from the following specific description of the preferred embodiments.

BRIEF DESCRIPTION OF THE DRAWINGS

In the drawings which form a part of this application, and in which like reference characters indicate like parts, FIG. 1 is a perspective view of a tow truck according to the invention, with its tow pin engaging a sub-floor conveyor;

FIG. 5 is a partial sectional view looking downwardly on the line 5—5 of FIG. 4; and FIG. 6 is a partial sectional view looking forwardly on the line 6—6 of FIG. 3, with some portions broken away and others shown in section.

DESCRIPTION OF THE PREFERRED EMBODIMENTS

Figure 4:
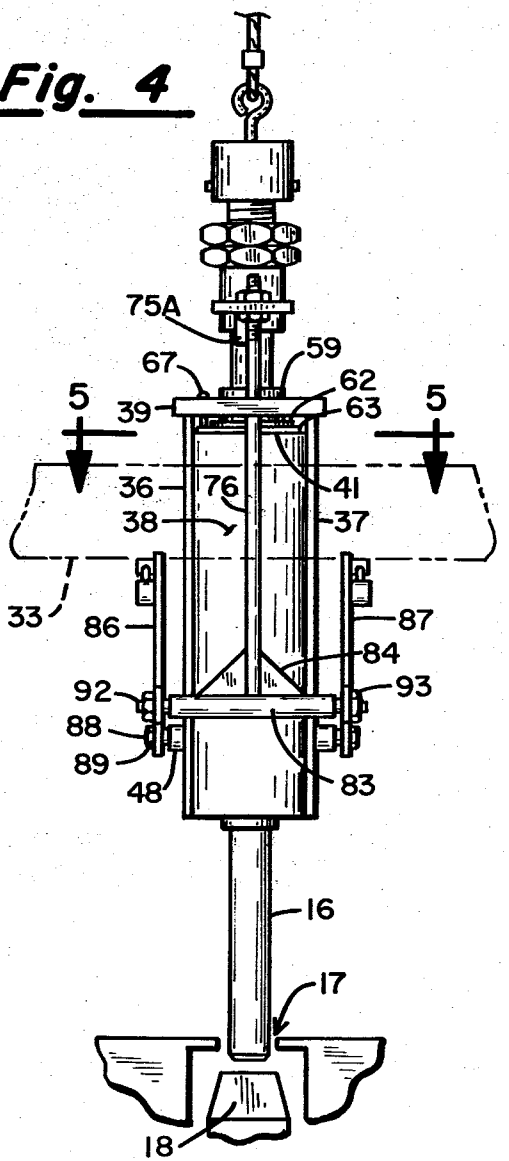
FIG. 4 is a front view of the portion of the mechanism shown in FIGS. 2 and 3, with the tow pin retracted as in FIG. 3.

As shown in FIG. 1, the present invention is illustrated in connection with a tow truck 11, having a flat body portion 12 on which a load can be supported. Front casters 13 are pivotally supported for rotation on a vertical axis to permit the front end of the truck to follow the desired path defined by a conveyor or by manual operation. The truck body has rear casters 14 which are secured against rotation on a vertical pivot, so that the rear of the truck will follow generally the path established by movement of the front end.

At the front end of the truck, a tow pin 16 is supported for relative vertical movement, so that its lower end can project downwardly through a floor slot 17 for engagement by one of the driving lugs 18 (FIG. 2) of a sub-floor powered conveyor chain, partially shown at 19. Thus, when the tow pin is in its lowered position, the conveyor chain will drive the tow pin and truck along the path defined by the conveyor slot 17.

For manual disengagement of tow pin 16 from its driving conveyor, the upper end of the tow pin has a cap member 21 connected by a lifting chain or cable 22 to a transversely extending crank rod 23 having supporting arms pivoted at 24 to front vertical frame members 26 of the tow truck body. Thus, an operator can lift crank rod 23 to pull the tow pin vertically to a level completely disengaged from floor slot 17 and conveyor 19.

The accumulation bumper 27 of the present truck extends at least partly across the front of the truck ad-head of the tow pin. The outer ends of the bumper are rigidly secured to the upper ends of bumper pivot arms 28, which have their lower ends supported by pivot pins 29 at the bottom of vertically extending bumper pivot support members 31 secured to a front cross frame member 33 at the leading edge of the truck body. The lower ends of support members 31 are further secured by rearwardly and upwardly extending support braces 32 connected to a truck body or frame member rearwardly of the leading edge 33.

Figure 3:
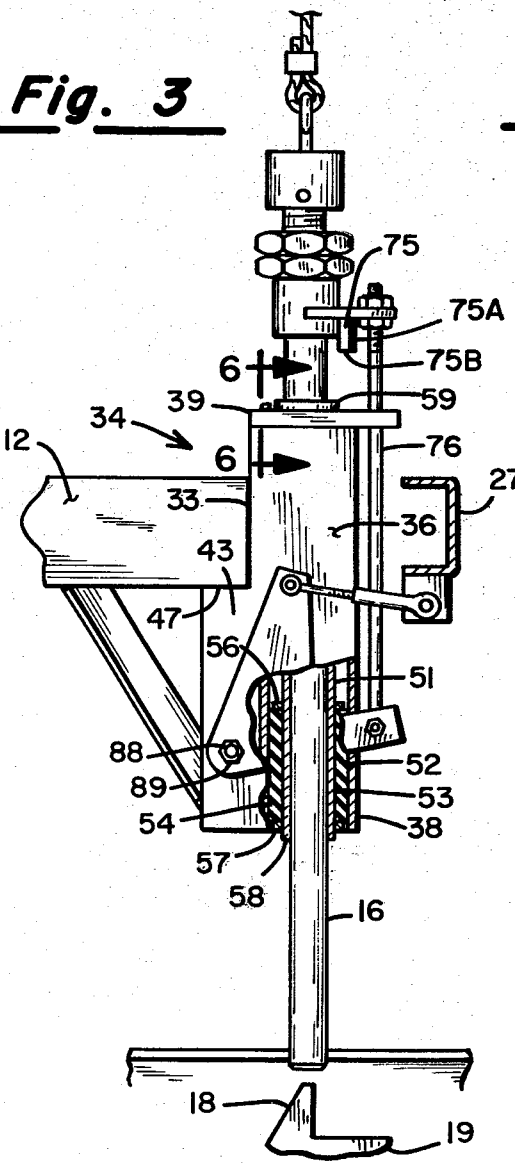
FIG. 3 is a view similar to FIG. 2, with the accumulation bumper of the truck in its retracted position.
Figure 2:
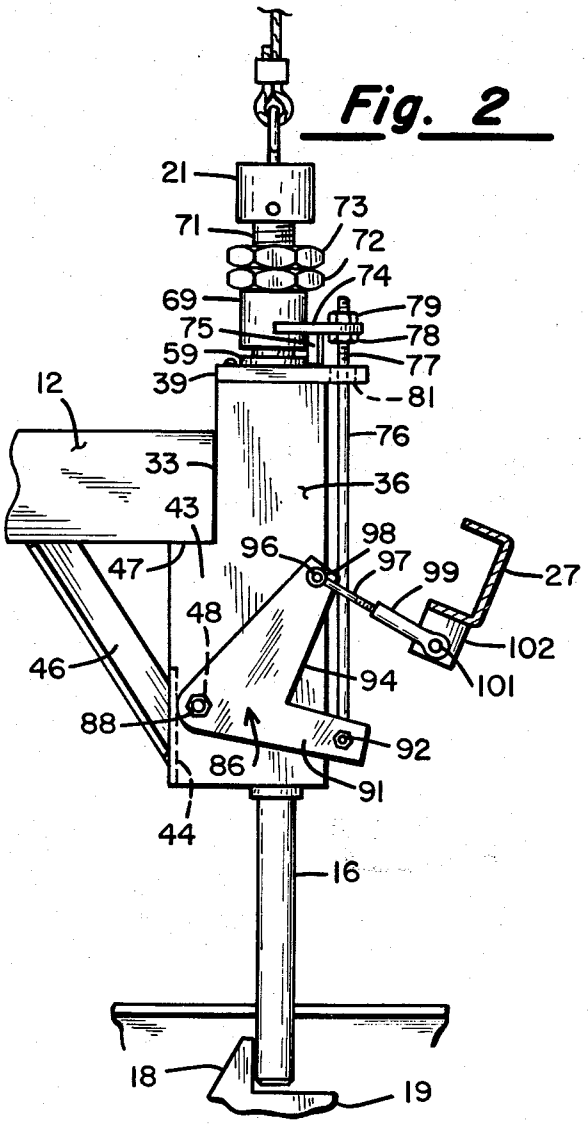
FIG. 2 is a partial side view of the front end of the truck of FIG. 1 with certain portions broken away and other portions shown in section, and with the bumper in its forward conveying position.

The axis of rotation of bumper 27 from the forward position of FIGS. 1 and 2 to the retracted position of FIG. 3 is defined by pivot pins 29 spaced at each side of the tow pin. The exact location is a matter of design. In this embodiment the pivot axis is below and ahead of the truck edge in the same vertical transverse plane as the tow pin 16 itself. The central portion of bumper 27 is curved forwardly from its side supports, so that the ends of bumper 27 can swing up very close to the front edge of the truck within supporting brackets 31, while the arcuate central portion of bumper 27 remains spaced from the front edge 33 sufficiently to accommodate the housing of the tow pin assembly shown generally at 34 in FIG. 1 and the connections between the bumper and tow pin. The tow pin housing includes right and left side plates 36 and 37 which extend longitudinally and vertically at each side of a tow pin housing tube 38 to which the side plates are welded or otherwise secured. The housing includes a top plate 39, and the side plates extend vertically above the top edge 41 of the housing tube (FIG. 6) to provide a limited horizontal and longitudinal space for the tow pin retainer clip 63 described below.

The tow pin housing side plates 36 and 37 have their vertical front edges generally in a transverse plane corresponding to the front edge of the housing tube 38. At their lower rear portions, however, the housing side plates include rearward extensions 43 which provide a supporting connection between the tow pin housing assembly and the front portion 33 of the truck. A cross plate 44 (FIG. 2) connects the lower rear edges of the side plates to each other and provides a backing for one end of a tow pin housing brace 46, which extends diagonally upwardly and rearwardly from the cross plate 44 to a bottom portion or cross frame member of the truck body 12 itself. The rearward extension 43 of each side plate also provides an upwardly facing shoulder 47 which fits beneath the front edge 33 of the truck body, while the remaining upper portions of the side plates 36 and 37 fit directly against such front edge. Thus the rear extensions 43 provide a reinforcing and positioning notch engaging the front lower corner of the truck body forward edge 33.

The rear plate extensions 43 also provide a supporting area for a pivot tube bearing 48 extending transversely behind the tow pin and beneath and behind the front edge 33 of the truck body, for pivotally supporting portions of the connecting linkage between the front bumper 27 and tow pin 16, as further described below. The side plates and rear extensions just described provide a preferred construction for supporting the tow pin assembly and connecting linkage, but other supports may be apparent from this description.

The described support provides an improved mounting arrangement for the tow pin 16 within the tow pin housing assembly. For this purpose, the tow pin itself is supported for vertical sliding movement within a tow pin guide tube 51, the outer diameter of which is somewhat less than the inner diameter of the housing tube 38. At the lower end of guide tube 51, a generally annular shock absorber 52 of rubber or other resilient material fits resiliently between guide tube 51 and housing tube 38. As shown in FIGS. 3 and 5, the inner surface 53 of shock member 52 is smoothly cylindrical and fits tightly around cylindrical guide tube 51. The outer surface 54 of shock member 52, however, is generally cylindrical, but has a fluted or irregular surface providing limited space within the housing tube for limited lateral or longitudinal displacement of the tow pin and guide tube within the housing tube in response to external forces against the tow pin. Thus the forces against the tow pin, for example when a conveyor lug 18 first strikes the tow pin to move it along the conveyor slot 17, is not fully and directly transmitted to the rest of the tow pin assembly and the truck body.

The shock member 52 is held in proper vertical position on the tow pin guide tube 51 by upper and lower washers 56 and 57 which may be welded or keyed to the guide tube 51.

The lower end 58 of tow pin guide 51 thus extends slightly below shock member 52 and washer 57, while the upper portion of the tow pin guide tube extends up through the housing assembly and projects at 59 slightly above top plate 39. To anchor the tow pin guide tube in proper vertical position, its upper portion is provided with a radial positioning washer member 62, welded or otherwise secured to the upper guide tube end as shown in FIG. 6. A retaining clip 63, the front cross portion of which is shown in FIG. 4, has rearwardly extending right and left arms 64 and 66 adapted to fit below the positioning washer 62 of the guide tube and be supported on the upper edge 41 of housing tube 38 between side plates 36 and 37. Since the positions of washer 62 and clip 63 vertically fixed between the lower surface of top housing plate 39 and the top 41 of housing tube 38, the guide tube 51 will be held in essentially the desired vertical position. At the same time, there is sufficient clearance space, as shown for example at 68, to permit some limited displacement of the upper end 59 of the guide tube 51 to accommodate limited shifting of the lower portion of the guide within its shock member, particularly in a longitudinal direction. A retaining screw 67 holds retaining clip 63 in assembled position, but can be removed during disassembly or assembly of the parts.

To provide the desired lifting of the tow pin 16 in response to engagement of the bumper 27 with an obstacle, the tow pin assembly includes a lift collar 69 which fits around the upper end of the tow pin just above the top 59 of the guide tube 51. The tow pin itself extends downwardly through the collar 69 and guide tube 59, and its downward vertical position is suitably adjustable by means of an adjusting nut 72 and a lock nut 73 on the threaded upper end 71 of the tow pin. Thus when the parts are in the position of FIG. 2, the nuts 72 and 73 may be adjusted to position the lower end of tow pin 16 at the desired depth for driving engagement by conveyor chain lug 18.

The lifting collar 69 has a forwardly projecting lift tab 74 which controls the vertical position of the collar and tow pin. To limit the downward movement of the tow pin, an angular stop member 75 has its top welded to the underside of tab 74 and its rear edge welded to the front of collar 69, with an angular flange 75A projecting laterally for reinforcement. The bottom 75B of member 75 projects downwardly below the bottom of collar 69 to engage the upper surface of housing top plate 39 and prevent actual contact between the bottom of the collar 69 and the top 59 of tow pin tube 51. Thus the lowermost position of the tow pin is determined, depending on the adjustment of nuts 72 and 73, without possible damage to the top of tube 51.

To raise the tow pin from the position of FIG. 2 to the position of FIGS. 3 and 4, the forwardly projecting lift tab 74 of lifting collar 69 has an opening through which the threaded upper end 77 of a lift rod 76 can project and be secured by adjusting nut 78 and lock nut 79. The upper end 77 of lift rod 76 extends through a forwardly projecting guide portion 81 of housing top plate 39. The guide slot 82 for the lift rod has a longitudinal cross section sufficient to accommodate slight longitudinal swinging of the lift rod 76 in response to limited arcuate movement of its lower end, which is secured to a lift rod cross tube or bearing 83, with reinforcing gussets 84.

Thus the lower end of the lift rod can be connected to and driven by one or more bell crank members, such as the right bell crank plate 86 and the left bell crank plate 87 which constitute an important feature of the present invention. These bell crank members 86 and 87 are pivotally supported at the ends of a transverse supporting shaft 88 extending transversely through the pivot tube or bearing 48 in the rear extensions 43 of the tow pin housing side plates. Shaft 88 may be shouldered at its outer ends, with lock nuts 89 holding the bell crank plates in the desired transverse spacing along each side of the tow pin and its housing. Each bell crank member has a forwardly extending crank arm 91, at the forward end of which a pivot shaft 92 is secured for pivotally supporting the cross tube 83 of the lift rod 76. Shaft 92 may also be shouldered and provided with lock nuts 93 to maintain the desired spacing and prevent binding of tube 83.

Each bell crank member also includes an upwardly extending crank arm 94, which carries an outwardly projecting pivot pin 96 at its upper end for appropriate connection to a linkage rod 97 having a tubular end 98 mounted on the pivot pin 96 and having a threaded forward end received by a corresponding internal threaded portion of an adjustable yoke or linkage end 99. The forward end of member 99 is pivotally supported on a pivot pin 101 secured to a mounting bracket 102 on the bumper 27. Thus members 97 and 99 provide a threaded adjustment for the effective length of the connecting link between bumper 27 and the pivot pin 96 on bell crank lever arm 94.

In operation, when bumper 27, in the position of FIG. 2, encounters an obstacle ahead of truck 11, the bumper will swing rearwardly around its lower pivot axes 29 to the position of FIG. 3. Members 97 and 99 constitute a longitudinally extending link which transmits this rearward movement of bumper 27 into rearward rocking movement of bell crank lever arm 94 around pivot 88. The same rocking movement raises bell crank lever arm 91, and this movement is transmitted by lift rod 76 to the lifting tab 74 and lifting collar 69 to raise the tow pin nuts 72 and 73 and the tow pin itself out of engagement with the conveyor lugs 18. As shown in FIGS. 3 and 4, the parts are designed to lift the tow pin only far enough to become disengaged from the conveyor lug, but not far enough to withdraw the tow pin completely from the floor slot 17. Thus the forward motion of the truck will stop, until the obstacle is removed, but the engagement of the tow pin end with the edges of the floor slot will prevent the truck from accidental or unintended movement away from the conveyor line, until or unless an operator raises the crank rod 23 to lift the tow pin completely out of the slot.

The assembly, operation and advantages of the present invention will be apparent from the foregoing description. For example, the use of the specific bell crank linkage described and shown, with its particular location and orientation, makes it possible to provide a connecting linkage between an accumulation bumper and a vertically movable tow pin which requires minimal longitudinal space ahead of the front edge of the truck body. By supporting the bell crank members for rotation at 88 on a transverse axis located below and rearwardly of the front edge of the truck, and by using bell crank arms 91 and 94 which project forwardly along the sides of the tow pin housing assembly, and by supporting the front bumper from a lower pivot axis in or somewhat behind the cross plane of the tow pin, an effective operating linkage can be achieved with minimal increase in the longitudinal dimension of the truck. In this case, it will also be noted that the pivotal connections 92 and 96 at the outer ends of bell crank lever arms 91 and 94 are somewhat less than 90 degrees apart, with reference to the pivotal axis 88 of the bell crank. The lever arm 92 can move through a limited arcuate path which extends almost equally below and above the horizontal, so as to require minimal forward and rearward rocking of the lower end of lift rod 76 and to provide an essentially "straight line" vertical driving connection for the tow pin lifting collar 69. The angular orientation of bell crank arm 94, and the relative vertical and longitudinal locations of the pivot 88 with respect to the pivot axis of the bumper 27 can be modified to provide direct transmission of the rearward bumper movement to the bell crank arm 94 with minimal rocking of connecting link 97, 99. The design in which lever arm 94 is inclined forwardly as well as upwardly makes it possible for the bumper 27 to rock the lever arm 94 rearwardly as far as necessary, without having the upper end of the lever arm strike against the forward edge 33 of the truck body. Thus the total construction of the tow pin housing assembly, accumulation bumper and interconnecting linkages can be accommodated within very limited vertical and longitudinal design limits.

Moreover, the improved linkage between the accumulating bumper and the tow pin provides a plurality of possible adjustments to accommodate necessary manufacturing tolerances as well as variations in operating conditions. Thus the longitudinal link between bumper 27 and bell crank lever arm 94 can be adjusted in length by relative rotation of its two threaded members 97 and 99. Similarly the effective length of lift rod 76 may be adjusted by means of nuts 78 and 79. The effective length of the bell crank lever arms from the bell crank pivot 88 to the respective pivots 92 and 96 can be selected to provide any desired relative mechanical advantage and any desired difference in the relative extent of movement desired for the tow pin, in relation to a predetermined desired movement of the bumper 27. As the relative length of crank arm 94 is increased, the bumper has greater mechanical advantage in lifting the tow pin, but the bumper must swing farther to lift the pin the same desired distance.

The bell crank linkage disclosed herein provides a relatively straight upward lifting force to raise the tow pin, as compared to those prior linkages in which a cam associated with a bumper might provide a tilting or non-vertical force component with friction or binding of the tow pin within its supporting tube. The symmetry of the linkage, with a bell crank member at each side of the tow pin, a longitudinal link from each upward crank lever to symmetrically spaced pivots on the bumper, and a single lift rod vertically adjacent the tow pin and effectively pivoted between the longitudinal bell crank levers, contributes to the smooth transmission of forces between the bumper and tow pin with minimal frictional losses or wearing of the parts due to tilting of the tow pin within its guide tube.

The provision of a strong housing supporting the tow pin tube, and the use of a tow pin lifting collar above the tow pin guide tube with a depending stop member to engage a portion of the tow pin support housing prevents dropping impact of the lifting collar directly onto the tow pin guide tube and possible damage to such guide tube. If the shock absorber arrangement is not needed for a particular application, the use of an outer housing tube can be omitted, and the housing side plates or equivalent housing support members can be welded or otherwise secured directly to the tow pin guide tube, with the lifting collar again having a stop portion or member which engages a stronger portion of the support housing to prevent damage to the top of the tow pin guide tube.

The foregoing specification accordingly sets forth certain preferred embodiments and modifications of the invention and some of the ways in which the invention may be put into practice, including the best mode presently contemplated by the inventors for carrying out this invention. Modification of the described embodiment, as well as alternate embodiments and devices for carrying out the invention, may also be apparent to those skilled in the art, within the spirit and scope of the following claims:

We claim:

1. In a tow truck having wheels supporting the truck for movement along a path defined by a floor conveyor, a generally vertical tow pin at the front of the truck movable between a lower driving position for driving engagement by such conveyor and an upper retracted position out of driving engagement with such conveyor, and an accumulation bumper at the front of the truck movable between a forwardly projecting normal running position ahead of the tow pin and track and a rearwardly retracted accumulating position in response to engagement of the bumper with an object ahead of the truck, an improved connecting mechanism between the bumper and tow pin comprising two bell crank members pivoted for rotation on a transverse axis behind the tow pin, with one bell crank member at each side of the tow pin and each bell crank member having a first lever arm projecting upwardly from such pivot and a second lever arm projecting forwardly from such pivot along its side of the tow pin, first and second longitudinally extending connecting links each having a rear end pivotally connected to the upper end of the corresponding first lever arm and a forward end pivotally connected to the bumper and rocking the first lever arms rearwardly in response to movement of the bumper to retracted position, said longitudinally extending connecting links pivotally connecting the first lever arms to the bumper at symmetrically spaced locations transversely from the tow pin, a cross member transversely connecting the forward ends of the second lever arms to each other, and a vertically extending lifting rod extending vertically along the tow pin and having a lower end pivotally connected to the cross member between the forward ends of the second lever arms and an upper end connected to the tow pin and lifting the tow pin in response to rearward rocking of the first lever arms by the bumper and connecting links.

2. In a tow truck having wheels supporting the truck for movement along a path defined by a floor conveyor, a generally vertical tow pin at the front of the truck movable between a lower driving position for driving engagement by such conveyor and an upper retracted position out of driving engagement with such conveyor, and an accumulation bumper at the front of the truck movable between a forwardly projecting normal running position ahead of the tow pin and truck and a rearwardly retracted accumulating position in response to engagement of the bumper with an object ahead of the truck, an improved connecting mechanism between the bumper and tow pin comprising at least one bell crank member pivoted for rotation on a transverse axis behind the tow pin and having a first lever arm projecting upwardly from such pivot, and a second lever arm projecting forwardly from such pivot along a side of the tow pin, a longitudinally extending connecting link having a rear end pivotally connected to the upper end of the first lever arm and a forward end pivotally connected to the bumper and rocking the first lever arm rearwardly in response to movement of the bumper to retracted position, a vertically extending lifting rod having a lower end pivotally connected to the forward end of the second lever arm and an upper end connected to the tow pin and lifting the tow pin in response to rearward rocking of the first lever arm by the bumper and connecting link and means for manual adjustment of the effective length of the lifting rod between its pivotal connection to the forward end of the second bell crank lever arm and the connection of its upper end to the tow pin.

3. A tow truck according to claim 2 having means for manual adjustment of the effective length of the longitudinal connecting link between the first bell crank lever arm and the bumper.

4. A tow truck according to claim 2 having additional adjusting means for manual adjustment of the relative vertical position of the tow pin independently of the means for manual adjustment of the effective length of the lifting rod.

5. In a tow truck having wheels supporting the truck for movement along a path defined by a floor conveyor, a generally vertical tow pin at the front of the truck movable between a lower driving position for driving engagement by such conveyor and an upper retracted position out of driving engagement with such conveyor, and an accumulation bumper at the front of the truck movable between a forwardly projecting normal running position ahead of the tow pin and truck and a rearwardly retracted accumulating position in response to engagement of the bumper with an object ahead of the truck, an improved connecting mechanism between the bumper and tow pin comprising at least one bell crank member pivoted for rotation on a transverse axis behind the tow pin and having a first lever arm projecting upwardly from such pivot, and a second lever arm projecting forwardly from such pivot along a side of the tow pin, a longitudinally extending connecting link having a rear end pivotally connected to the upper end of the first lever arm and a forward end pivotally connected to the bumper and rocking the first lever arm rearwardly in response to movement of the bumper to retracted position, a vertically extending lifting rod having a lower end pivotally connected to the forward end of the second lever arm and an upper end connected to the tow pin and lifting the tow pin in response to rearward rocking of the first lever arm by the bumper and connecting link, a tow pin housing including a vertical tow pin guide tube in which the tow pin slides vertically, a supporting housing connected to the truck and supporting the tow pin guide tube at the front of the truck, said housing having a top portion through which the upper end of the guide tube is accessible, a vertically movable lift collar slidably fitting the tow pin just above the guide tube for lifting the tow pin, said lift collar having a lift tab with a connection to the upper end of the lifting rod, the lift collar also having a stop member thereon projecting downwardly below the collar and engaging the housing and preventing direct downward contact of the lift collar with the upper end of the guide tube, and said tow pin having a vertically adjustable stop above the lift collar establishing the relative lowermost vertical location at which the tow pin is supported by the lift collar, collar stop member and housing.

6. A tow truck according to claim 5 in which the tow pin housing has a top plate, the upper end of the tow pin guide tube projects above the top plate, and the downwardly projecting stop member on the lifting collar engages the stop plate and prevents downward contact of the lifting collar against the upper end of the tow pin guide tube.

7. In a tow truck having wheels supporting the truck for movement along a path defined by a floor conveyor, a generally vertical tow pin at the front of the truck movable between a lower driving position for driving engagement by such conveyor and an upper retracted position out of driving engagement with such conveyor, and an accumulation bumper at the front of the truck movable between a forwardly projecting normal running position ahead of the tow pin and truck and a rearwardly retracted accumulating position in response to engagement of the bumper with an object ahead of the truck, an improved connecting mechanism between the bumper and tow pin comprising two bell crank members pivoted for rotation on a transverse axis behind the tow pin, with one bell crank member at each side of the tow pin and each bell crank member having a first lever arm projecting upwardly from such pivot and a second lever arm projecting forwardly from such pivot along its side of the tow pin, first and second longitudinally extending connecting links each having a rear end pivotally connected to the upper end of the corresponding first lever arm and a forward end pivotally connected to the bumper and rocking the first lever arms rearwardly in response to movement of the bumper to retracted position, said longitudinally extending connecting links pivotally connecting the first lever arms to the bumper at symmetrically spaced locations transversely from the tow pin, a cross member transversely connecting the forward ends of the second lever arms to each other, a vertically extending lifting rod extending vertically along the tow pin and having a lower end pivotally connected to the cross member between the forward ends of the second lever arms and an upper end connected to the tow pin and lifting the tow pin in response to rearward rocking of the first lever arms by the bumper and connecting links, said tow truck also having a body portion with a front edge, an angular spacing between the pivotal connections at the ends of the first and second lever arms with reference to the transverse axis of rotation of each bell crank member of less than 90°, in which said bell crank axis of rotation is below and behind said front edge of the truck, and said first lever arms extend upwardly and forwardly from such axis with their pivotal connections positioned forwardly just ahead of said front edge when the bumper is in retracted position, and said first lever arms swinging forwardly along each side of the tow pin when the bumper is extended to its forward position.

8. A tow truck according to claim 7 in which the bumper extends transversely ahead of the front edge of the truck with a depending support arm at each end, a bumper support bracket extending downwardly from the front truck edge, said bumper support arm and bumper support bracket having lower ends pivotally connected to each other for rotation of the bumper on a transverse axis just ahead of and substantially below said front edge, the bumper having a central portion located ahead of its ends, with said central portion positioned ahead of the tow pin and said bumper ends positioned close to said front edge when the bumper is in retracted position.

9. A tow truck according to claim 8 in which said bumper pivot axis is below and ahead of the transverse axis of rotation of the bell crank members and extends generally in line with the tow pin.

10. In a tow truck having wheels supporting the truck for movement along a path defined by a floor conveyor, a generally vertical tow pin at the front of the truck movable between a lower driving position for driving engagement by such conveyor and an upper retracted position out of driving engagement with such conveyor, and an accumulation bumper at the front of the truck movable between a forwardly projecting normal running position ahead of the tow pin and truck and a rearwardly retracted accumulating position in response to engagement of the bumper with an object ahead of the truck, an improved connecting mechanism between the bumper and tow pin comprising two bell crank members pivoted for rotation on a transverse axis behind the tow pin, with one bell crank member at each side of the tow pin and each bell crank member having a first lever arm projecting upwardly from such pivot and a second lever arm projecting forwardly from such pivot along its side of the tow pin, first and second longitudinally extending connecting links each having a rear end pivotally connected to the upper end of the corresponding first lever arm and a forward end pivotally connected to the bumper and rocking the first lever arms rearwardly in response to movement of the bumper to retracted position, said longitudinally extending connecting links pivotally connecting the first lever arms to the bumper at symmetrically spaced locations transversely from the tow pin, a cross member transversely connecting the forward ends of the second lever arms to each other, a vertically extending lifting rod extending vertically along the tow pin and having a lower end pivotally connected to the cross member between the forward ends of the second lever arms and an upper end connected to the tow pin and lifting the tow pin in response to rearward rocking of the first lever arms by the bumper and connecting links, said tow truck also having a tow pin housing which includes two parallel vertically extending side plates, one of which is located at each side of the tow pin tube, each side plate having a vertical rear edge engaging a front edge of the truck, and each side plate rear edge having a rearwardly extending lower portion projecting beneath the truck, a cross brace portion connecting said lower portions to each other, and a reinforcing bracket between said cross brace portion and truck.

11. A tow truck according to claim 10 having a bearing tube extending transversely through and supported by the rearwardly extending lower portions of the tow pin housing side plates along the transverse axis of rotation of the bell crank member, and a bell crank pivot shaft supported in said bearing tube.

12. A tow truck according to claim 10 or 11 having a tow pin housing comprising a vertical housing tube, a vertical tow pin guide tube spaced within the housing tube, a resiliant shock-absorbing member between the lower ends of the guide tube and housing tube, cooperating connecting members at the upper ends of the housing tube and guide tube preventing relative vertical movement but permitting limited relative transverse and longitudinal movement in response to corresponding forces against the tow pin, the tow pin being supported for vertical sliding movement within the guide tube, and means connecting the tow pin housing tube to the front of the truck.

* * * * *